US011679959B2

(12) United States Patent
Ilvonen et al.

(10) Patent No.: US 11,679,959 B2
(45) Date of Patent: Jun. 20, 2023

(54) COMPENSATION GUIDE, COUNTERWEIGHT SCREEN, ELEVATOR AND METHOD

(71) Applicant: KONE Corporation, Helsinki (FI)

(72) Inventors: Oskari Ilvonen, Helsinki (FI); Pauli Waselius, Helsinki (FI); Mikko Viljanen, Helsinki (FI); Tuomas Rantala, Helsinki (FI); Olli Männistö, Helsinki (FI); Esa Suorsa, Helsinki (FI)

(73) Assignee: KONE Corporation, Helsinki (FI)

( * ) Notice: Subject to any disclaimer, the term of this patent is extended or adjusted under 35 U.S.C. 154(b) by 135 days.

(21) Appl. No.: 17/202,753

(22) Filed: Mar. 16, 2021

(65) Prior Publication Data

US 2021/0339983 A1 Nov. 4, 2021

(30) Foreign Application Priority Data

Apr. 30, 2020 (EP) ..... 20172299

(51) Int. Cl.
*B66B 7/06* (2006.01)
*B66B 5/00* (2006.01)

(52) U.S. Cl.
CPC ..... *B66B 7/068* (2013.01); *B66B 5/0043* (2013.01); *B66B 5/0056* (2013.01)

(58) Field of Classification Search
CPC ..... B66B 5/0043; B66B 5/005; B66B 7/068
See application file for complete search history.

(56) References Cited

U.S. PATENT DOCUMENTS 1,944,772 A * 1/1934 White ..... B66B 7/068 187/265
2,270,441 A * 1/1942 Hymans ..... B66B 7/068 187/304
2,295,381 A * 9/1942 Bouton ..... B66B 7/068 188/65.3
11,267,676 B2 * 3/2022 Häderer ..... B66B 7/06
2005/0133312 A1 * 6/2005 Kaczmarek ..... B66B 7/068 187/412
2005/0217940 A1 * 10/2005 Mori ..... B66B 7/068 187/226
2008/0083587 A1 * 4/2008 Bloch ..... B66B 5/28 187/343
2008/0196981 A1 * 8/2008 Liland ..... B66B 7/068 242/615.4

(Continued)

FOREIGN PATENT DOCUMENTS

CN 108657907 A * 10/2018 ..... B66B 1/46
EP 3263504 A1 1/2018

(Continued)

OTHER PUBLICATIONS

Search Report issued in European Priority Application 20172299.8, dated Nov. 16, 2020.

*Primary Examiner* — Minh Truong
(74) *Attorney, Agent, or Firm* — Birch, Stewart, Kolasch & Birch, LLP

(57) ABSTRACT

A compensation guide, counterweight screen, traction elevator and method for guiding a compensation element are disclosed. The compensation guide includes a horizontally directed guide opening through which the compensation guide passes. The guide is mounted vertically movably to the counterweight screen.

20 Claims, 4 Drawing Sheets

(56) References Cited

U.S. PATENT DOCUMENTS

| | | | | |
|---|---|---|---|---|
| 2017/0022030 | A1* | 1/2017 | Bai | B66B 7/068 |
| 2019/0177126 | A1* | 6/2019 | Murata | B66B 7/068 |

FOREIGN PATENT DOCUMENTS

| | | | |
|---|---|---|---|
| EP | 3398894 | A1 | 11/2018 |
| EP | 3401264 | A1 | 11/2018 |
| JP | 5-24769 | A | 2/1993 |
| JP | 7-315717 | A | 12/1995 |

* cited by examiner

COMPENSATION GUIDE, COUNTERWEIGHT SCREEN, ELEVATOR AND METHOD

BACKGROUND OF THE INVENTION

The invention relates to a compensation guide for guiding a compensation element arranged between a counterweight frame and an elevator car of an elevator.

The invention further relates to a counterweight screen, traction elevator and method for supporting a compensation element of a traction elevator.

The field of the invention is defined more specifically in the preambles of the independent claims.

In high-rise buildings traction elevators need to be provided with compensation elements, such as a chains, ropes, cables or belts, which connect bottom parts of a counterweight and a car. The compensation element is hanging in an elevator shaft below the vertically movable counterweight and the car. Purpose of the compensation element is to counter-balance weight of suspension ropes. Since the compensation element may begin to swing, different compensation guides are developed. However, the known solutions have shown to contain some disadvantages.

BRIEF DESCRIPTION OF THE INVENTION

An object of the invention is to provide a novel and improved compensation guide, counterweight screen, traction elevator and method for guiding a compensation element.

The compensation guide according to the invention is characterized by the characterizing features of the first independent apparatus claim.

The counterweight screen according to the invention is characterized by the characterizing features of the second independent apparatus claim.

The traction elevator according to the invention is characterized by the characterizing features of the third independent apparatus claim.

The method according to the invention is characterized by the characterizing features of the independent method claim.

An idea of the disclosed solution is that a compensation guide or guide device is mounted to a counterweight screen or guard at a pit of an elevator shaft. Furthermore, the compensation guide is allowed to move vertically relative to the fixedly mounted counterweight screen. The guide is configured to provide support for a loop portion of the compensation element hanging in the elevator shaft. Therefore, a guide opening, through which the loop portion passes, is directed horizontally. During normal operation of the elevator the compensation guide is located at its lower initial position at a bottom part of the screen and, in case there exist a so called buffer strike causing the compensation element to jump i.e. to move suddenly upwards, then the compensation guide moves in upward direction and continues providing proper support for the compensation element. Thus, the guide may be considered to be dynamically movable in vertical direction during the operation.

An advantage of the disclosed compensation guide is that the horizontal compensation guide provides the loop part of the compensation element with proper support in the normal elevator operation as well as in buffer strike situations. The guide is allowed to move vertically together with a horizontal portion of the loop of the compensation element. The guide is not located below the vertically moving counterweight, whereby no collision between the counterweight and the guide is possible when the counterweight strikes a buffer mounted at a counterweight movement space. Thus, there is no need to reserve redundant vertical clearance distance below the counterweight for preventing collisions, whereby height of the counterweight frame may be increased, which may provide several advantages for the design of the elevator. Due to the disclosed structure more options are available for designing space efficient low pit elevator configurations. When the disclosed solution allows increasing effective vertical dimensions of the counterweight assembly, it also allows to implement in a more versatile manner different materials for plates or tanks of the counterweight.

Since the compensation guide is supported to the fixedly mounted counterweight screen, the guide is well supported and its vertical movements have proper guidance.

A further advantage is that the structure is simple, inexpensive and durable.

Since the guide is supported to the counterweight guard and not to the buffer of the counterweight, there is no need use any specially designed buffers and support structures connected to them. Thereby, normal buffers with simpler structure and lower price can be implemented.

According to an embodiment, the disclosed compensation guide is supported only to the screen and requires no additional support means.

According to an embodiment, the disclosed compensator guide is mountable to any counterweight screen or guard. The screen may be made of metallic material, composite material, plastic material or any suitable material for providing proper guard and fulfilling set requirements. Further, the disclosed guide may be retrofittable to any existing screen. The screen may already comprise an opening at a bottom part of the screen whereby it is relatively easy to mount the guide to the opening. In case not vertical opening exist, it is easy to cut the opening by means of normal tools.

According to an embodiment, the guide is freely movable in vertical direction. The guide simply follows movement of the loop part of the compensation element in case of a buffer strike.

According to an embodiment, the guide is freely movable in the vertical direction along a vertical movement range due to the bearing elements whereby the bearing elements provide the guide with a floating mounting relative to the supporting structure.

According to an embodiment, the guide has two part form comprising two halves connectable to each other. In other words, the structure of the guide can be opened in order to facilitate the mounting. The guide can be opened, arranged around the compensation element and finally reassembled.

According to an embodiment, the guide comprise more than two parts connectable to each other. In other words, the structure of the guide can be assembled of three, four, or even more components in order to facilitate the mounting. The guide can be opened, arranged around the compensation element and finally reassembled.

According to an embodiment, the bearing elements of the guide comprise slide surfaces on opposite vertical sides of the body. Slide bearing provides simple, reliable and inexpensive bearing for the guide.

According to an embodiment, the body is provided with removable slide bearing elements. Then the slide bearing elements can be manufactured separately and desired slide bearing materials can be used. The bearing elements may also be changed later on if needed.

According to an embodiment, both slide bearing element comprise a groove configure to receive an edge portion of a plate like support structure. Then, inner sides of the groove as well as a bottom of the groove are part of the slide bearing element.

According to an embodiment, the slide surfaces are made of slide bearing plastic material, such as polyamide (nylon), polyether ether ketone (PEEK), polyacetal (POM) or polyethylene.

According to an embodiment, the bearing elements of the guide comprise bearing rollers on opposite vertical sides of the body. There may be side rollers facing towards side surfaces of the edge portion, edge rollers facing towards the edges of the opening.

According to an embodiment, the guide comprises a bearing arrangement which is a combination of a slide bearing solution and a bearing roller solution. In other words, different bearing solutions can be utilized in versatile manner.

According to an embodiment, an opening at a bottom part of the screen is provided with vertical slide elements or corresponding vertical bearing or guiding bars. Further, the guide or support bars may reinforce the edge portions of the opening.

According to an embodiment, an opening at a bottom part of the screen is provided with a frame element configured to frame the opening. The frame element may comprise bearing surfaces, Further, the frame element may reinforce the edge portions of the opening.

According to an embodiment, an edge portion of the horizontally directed opening of the guide is provided with slide bearing plastic material, such as polyamide (nylon), polyether ether ketone (PEEK), polyacetal (POM) or polyethylene. There may be a plastic bearing ring surrounding the opening. The plastic bearing ring or sleeve may facilitate movement of the compensation element relative to the guide due to lower friction, and it may also dampen possible noise caused by the compensation element.

According to an embodiment, the mentioned bearing ring may alternatively be made of metallic slide bearing material, such as slide bearing bronze.

According to an embodiment, the mentioned bearing ring may be one uniform piece or alternatively it may comprises two, three or even more pieces which are connectable to each other.

According to an embodiment, the solution relates to a counterweight screen which is mountable to a pit of an elevator shaft and is configured to serve as a partition wall for preventing objects to enter into a vertical movement space of a counterweight of a traction elevator. In other words, the counterweight screen is a protective safety cover. The screen comprises a panel having rectangular shape with two vertical side edges, a horizontal top edge and a horizontal bottom edge. The mentioned panel is provided with at least one longitudinal opening extending a distance from the bottom edge towards the top edge. Further, the screen is provided with at least compensating guide mounted vertically movably to the mentioned opening. The mentioned compensation guide is in accordance with the features disclosed in this document.

According to an embodiment, the screen may be made of metallic, plastic or composite material, for example.

According to an embodiment, the screen is a planar object.

According to an embodiment, the screen may be transparent or it may be mesh like object provided with openings.

According to an embodiment, the longitudinal edges of the opening of the screen are configured to provide support for the guide.

According to an embodiment, the guide comprises grooves facing towards the vertical edges of the longitudinal opening. The grooves provide the guide with proper support and guidance.

According to an embodiment, the disclosed solution relates to a traction elevator comprising: a car assembly provided with an elevator car; a counterweight assembly provided with a counterweight frame and at least one filler element; a first guide assembly provided with first vertical guide rails mountable to the elevator shaft and first guide shoes mountable to the car assembly, and correspondingly a second guide assembly provided with second vertical guide rails and second guide shoes for the counterweight frame and wherein the mentioned guide shoes are supportable against the guide rails; a hoisting machinery comprising an electric motor and a traction sheave driven by means of the electric motor; at least one suspension rope connecting the car assembly and the counterweight assembly and arranged to pass over the traction sheave; at least one compensation element arranged between bottom parts of the counterweight assembly and the car assembly and comprising vertically hanging two vertical parts in the elevator shaft and a loop part connecting the vertical parts; at least one compensation guide for providing support for the compensation element and comprising at least one guide opening through which the compensation element is arranged to pass; a counterweight screen arranged at a pit of the elevator shaft and configured to serve as a guard structure preventing objects entering on movement path of the counterweight assembly. Furthermore, the compensation guide is arranged at the mentioned loop portion of the compensation element whereby the compensation element is configured to be guided through a horizontally directed guide opening of the guide. The guide and the screen are in accordance with the features disclosed in this document.

According to an embodiment, the counterweight screen divides a bottom part of the pit into a counterweight space and a car space and to thereby serve as a guard structure between the spaces. The screen can be mounted to the above mentioned second vertical guide rails arranged for the counterweight frame. Alternatively, the screen can be mounted to walls of the pit.

According to an embodiment, the disclosed solution relates to a method for providing guidance for a compensation element of a traction elevator. The compensation element is arranged between bottom parts of a counterweight assembly and a car assembly of the elevator and comprises vertically hanging two vertical parts in an elevator shaft and a loop part connecting the vertical parts. The method comprises directing the loop part of the compensation element through a horizontally directed guide opening of at least one compensation guide.

According to an embodiment, the method further comprises supporting the compensation guide vertically movably to a counterweight screen of the elevator.

According to an embodiment, the method further comprises providing the horizontal compensation guide with a floating mounting and allowing it to move vertically upwards from its initial normal position. The guide moves along with the compensation element.

According to an embodiment, the method further comprises allowing the compensation guide to move vertically upwards in situation when the counterweight assembly is moved against a buffer whose vertical length is configured to shorten due to a buffer strike.

According to an embodiment, the disclosed solution comprises at least one detecting device, sensor or measuring device mounted in connection with the compensation guide or the screen to sense movements of the guide. Generated sensing data is transmitted to at least one control unit or electrical terminal device configured to control or monitor operation of the elevator.

According to an embodiment, the disclosed solution comprises at least one spring element arranged in connection with the compensation guide. The spring element may be an elastic element or a mechanical spring. The spring element may keep the guide element in a desired vertical position in normal operational situations and allow the guide to move in special situations. The spring element or several elements affecting vertical movements of the guide may be arranged between the guide and the screen, or between the guide and a bottom surface of the pit.

According to an embodiment, the disclosed solution comprises at least one damper, damper element or damper device arranged in connection with the compensation guide. The damper is configured to dampen possible vibrations in the compensation guide. The damper of the guide may be arranged between the guide and the screen, or between the guide and a bottom surface of the pit.

According to an embodiment, weight by volume of the counterweight may be lower since volume of counterweight assembly may be greater than before. This way the greater volume allows use of lower priced filler materials. Filler pieces or plates made of material having lower specific weight are also easier and safer to handle when being loaded on load supporting frame of the counterweight assembly. The mentioned greater volume of the counter weight is possible since the counterweight can be dimensioned to extend greater distance in lower direction since there is no risk of collision between the counterweight assembly and the guide.

The above disclosed embodiments may be combined in order to form suitable solutions having those of the above features that are needed.

BRIEF DESCRIPTION OF THE FIGURES

Some embodiments are described in more detail in the accompanying drawings, in which.

For the sake of clarity, the figures show some embodiments of the disclosed solution in a simplified manner. In the figures, like reference numerals identify like elements.

DETAILED DESCRIPTION OF SOME EMBODIMENTS

Figure 1:
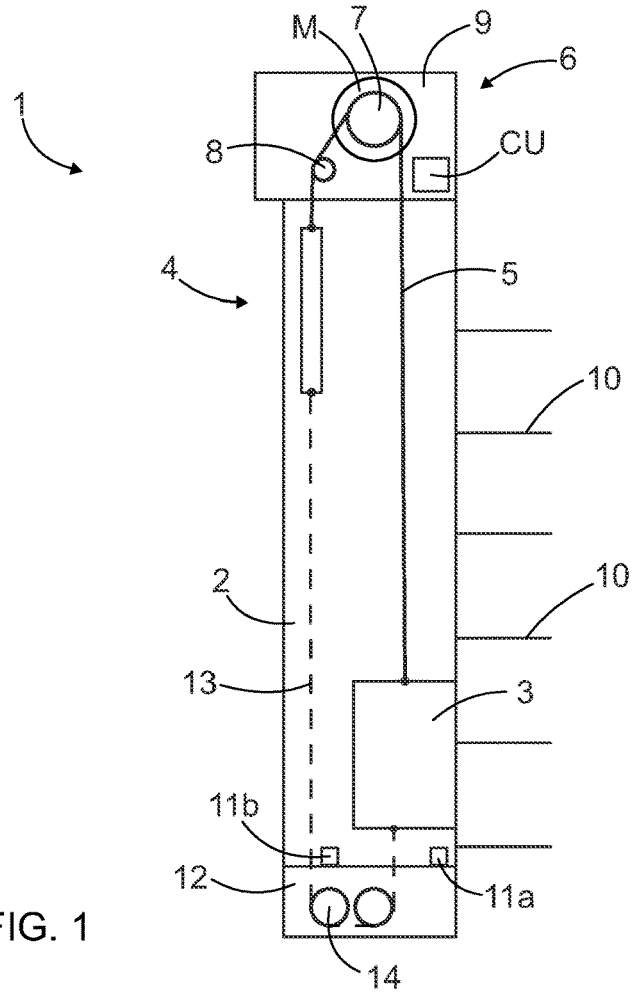
FIG. 1 is a schematic and highly simplified side view of a traction elevator.

FIG. 1 discloses a traction elevator 1 mounted to an elevator shaft 2 of a building. The elevator 1 comprises an elevator car 3 for receiving load to be transported. The car 3 and a counterweight assembly 4 are suspended form a suspension rope 5 passing via a hoisting machinery 6. The hoisting machinery 6 comprises a traction sheave 7 driven by means of an electric motor M. Between the suspension rope 5 and the traction sheave 7 occurs friction which is utilized for transmitting lifting power to the elevator system. The hoisting machinery 6 may comprise one or more additional pulleys 8 for guiding and controlling the suspension rope 5. Further, different rope schemas and rations may also be implemented. The hoisting machinery 6 may be located at an upper machine room 9, or alternatively the system may be a so called machine room less elevator. The car 3 can be driven to desired levels 10 or floors under control of one or more control units CU. Further, at a bottom of a pit 10 of the shaft 2 are buffers 11*a*, 11*b*. The buffer 11 is a device configured to stop the descending car 3 and the counterweight 4 beyond its normal limit. The buffer 11 is arranged to soften the forces with which the elevator 1 runs into the pit 12 during special situations. Further, the bottom of the car 3 and a bottom of the counterweight assembly 4 are connected by means of a compensator element 13, such as a chain, wire or belt. The compensator element 13 may pass via a compensator pulley 14 located at the pit. The compensator element 13 may be supported and guided as it is disclosed in this document. Details of the solution are disclosed in other Figures.

Figure 2:
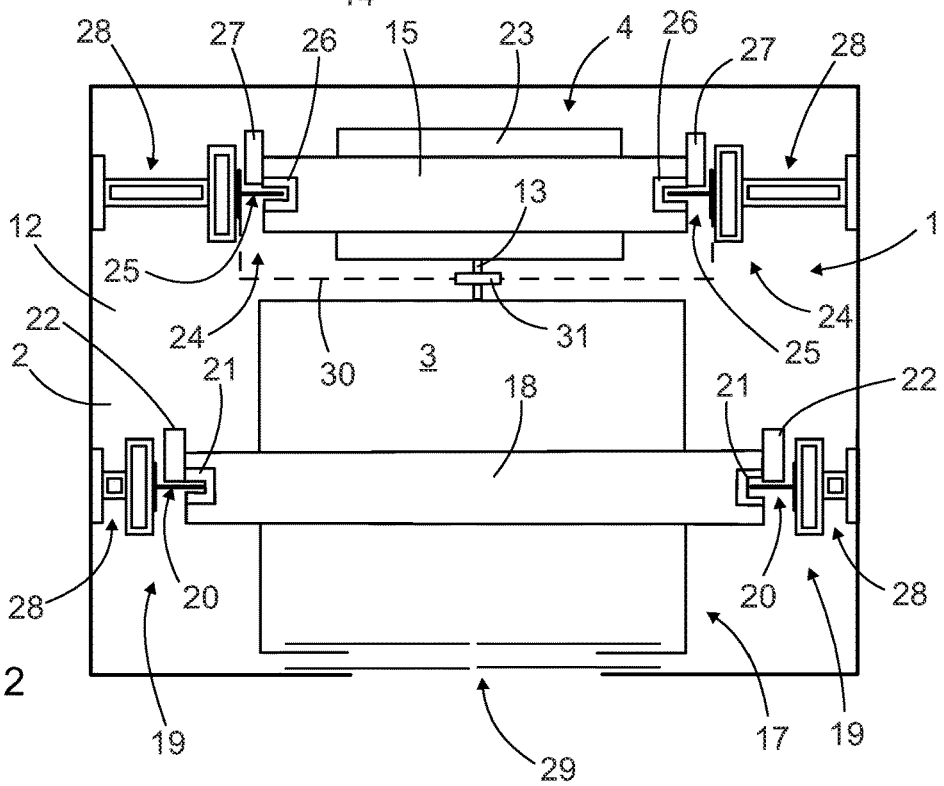
FIG. 2 is schematic top view of an elevator car assembly and a counterweight assembly and their guide systems.

FIG. 2 shows that a car assembly 17 comprises an elevator car 3 and a support element 18. The car assembly 17 is supported to the elevator shaft 2 by means of a first guide assembly 19 comprising first vertical guide rails 20 mounted to inner surfaces of the elevator shaft 2 and first guide shoes 21 mounted to the support element 18. There may also be breaking shoes 22 or devices as well as security arrangements at the guide assembly 19.

A counterweight assembly 4 comprises a counterweight frame 15 and filler elements 23. The frame 15 is supported to the elevator shaft 2 by means of a second guide assembly 24 comprising second vertical guide rails 25 and second guide shoes 26. Also the counterweight assembly 4 may be provided with breaking shoes 27 for decelerating movement of the counterweigh assembly 4.

Figure 3:
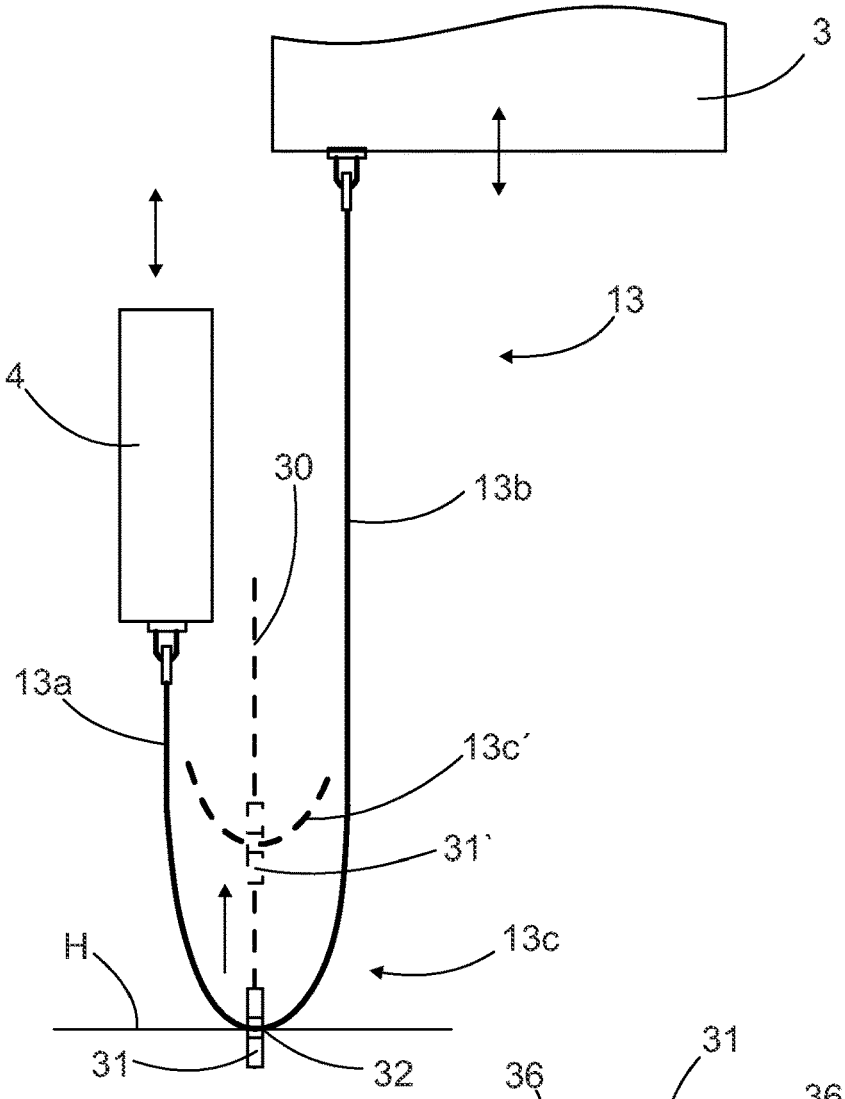
FIG. 3 is a schematic side view of a compensation arrangement.

FIG. 2 furthers shows that the guide assemblies 19 and 24 may be supported to the elevator shaft 2 by means of beam structures 28. The elevator shaft 2 and the car 3 are provided with a door system 29, of course. In FIG. 3 suspension rope and pulleys are nor shown for clarity reasons.

FIG. 2 also discloses that the counterweight assembly 4 is provided with a counterweight screen 30, which may be mounted to the guide rails 25 or the beam structures 28. The counterweight screen 30 or guard is a protective safety cover which is intended to guard the path of the counterweight 4 and to prevent any object from entering into the path of the counterweight 4. The screen 30 is provided with a compensation guide 31 through which a compensation element 13 passes. The compensation element 13 may be a wire rope or a plastic coated chain installed to obtain suspension rope weight compensation. One end of the counterweight element 13 is fastened to an underside of the elevator car 3 and the other end to the counterweight 4.

FIG. 3 discloses a compensation element 13 arranged between the bottom parts of a car 3 and the counterweight 4, and comprising two straight vertical portions 13*a*, 13*b* and a loop portion 13*c*. Between movement paths of the car 3 and the counterweight 4 there is a vertically mounted counterweight screen 30 at a pit portion. The screen 30 is provided with a compensation guide 31 which provides support for the loop portion 13*c*. As can be seen, the loop 13*c* passes through an opening 32 of the guide, which opening is directed horizontally H. The guide 31 can move from its initial normal position in upward direction relative to the screen 30. The shifted position of the guide 31' and the loop 13*c*' are shown in broken lines.

Figure 4:
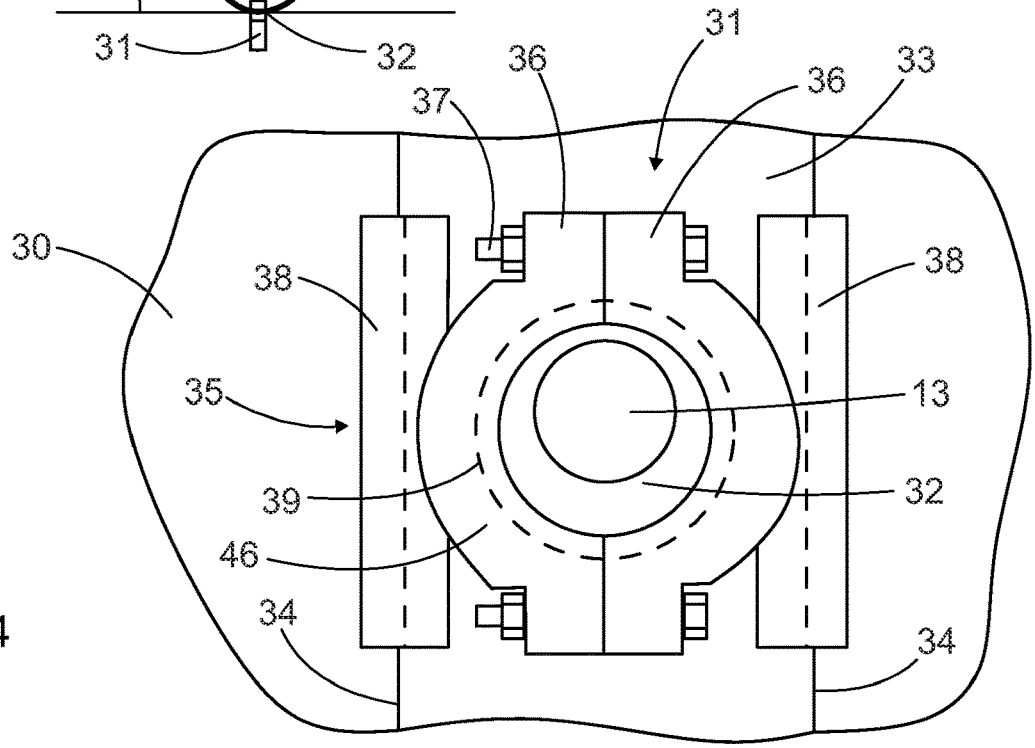
FIG. 4 is a schematic side view of a compensation guide.

FIG. 4 discloses a compensation guide 31 which is mounted to an opening 33 formed to a counterweight screen 30. The opening 33 may have longitudinal shape and comprises opposite vertical edges 34. The guide 31 comprises a body 35 which have two part configuration and may comprise two halves 36 fastened to each other by screws 37. There may be slide bearings 38 for supporting the guide 31 to edges 34 of the opening 33. The slide bearings 38 may be as it is disclosed above in this document. A guide opening 32 receives a compensation element 13. The guide opening 32 may or may not be provided with slide bearing ring 39 or corresponding structure. The guide 31 is provided with a guide portion 46 with a guide opening 32.

Figure 5:
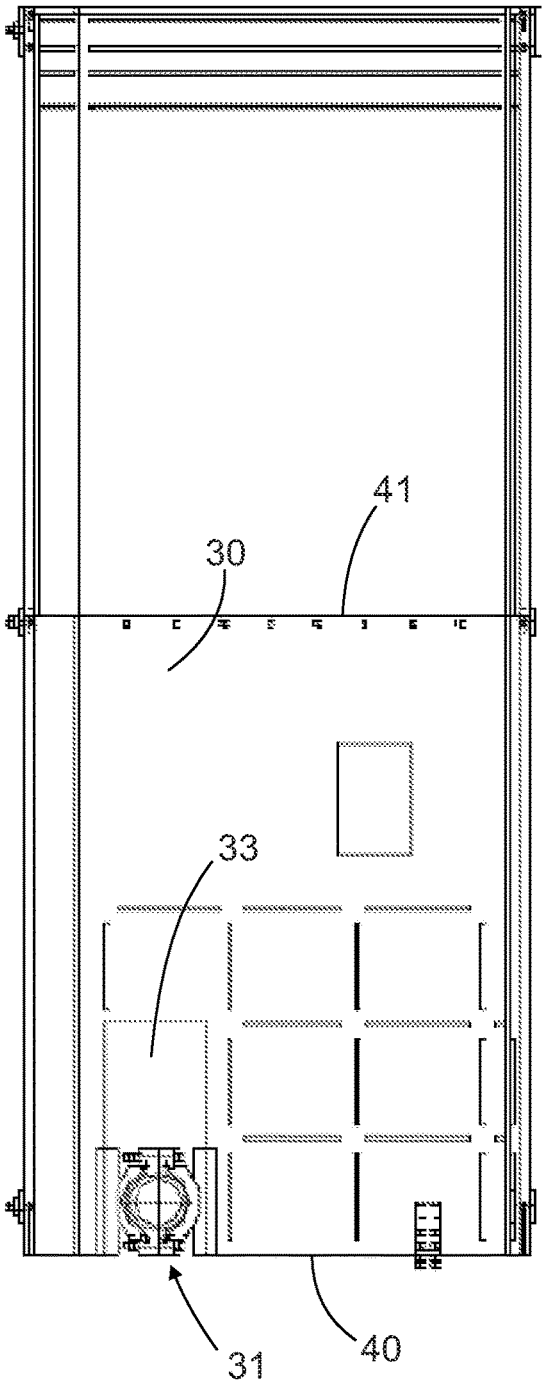
FIG. 5 is a schematic side view of a counterweight screen provided with a vertically movable compensation guide and FIG. 6 discloses the same in buffer strike situation.

FIG. 5 discloses a compensation guide 31 in a normal operational position. The guide 31 is mounted to an opening 33 of a counterweight screen 30. The opening 33 extends a distance from a bottom edge 40 of the screen 30 towards a top edge 41.

Figure 6:
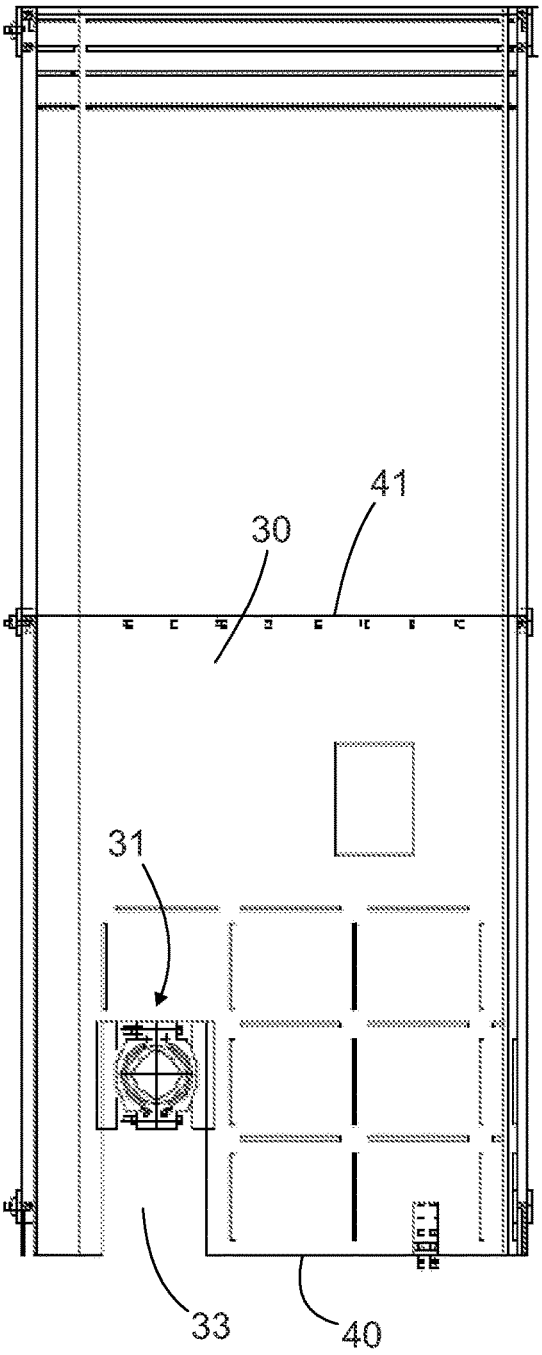

In FIG. 6 the guide 31 is moved to its extreme upper position. Thus, the guide 31 has a vertical movement range.

Figure 7:
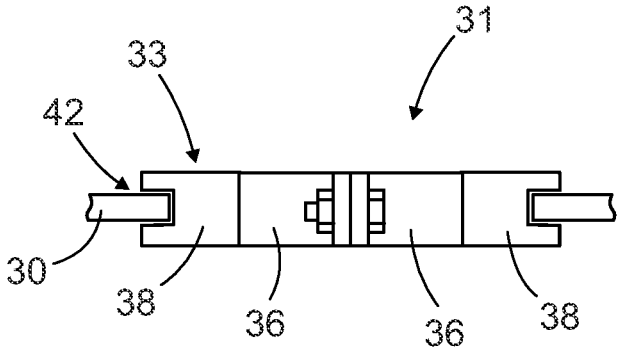
FIG. 7 is a schematic top view of a compensation guide provided with grooves.

FIG. 7 discloses that a guide 31 may be provided with grooves 42 facing towards edges of an opening 33 of a screen 30. These features are already discussed in more detailed above in this document.

Figure 8:
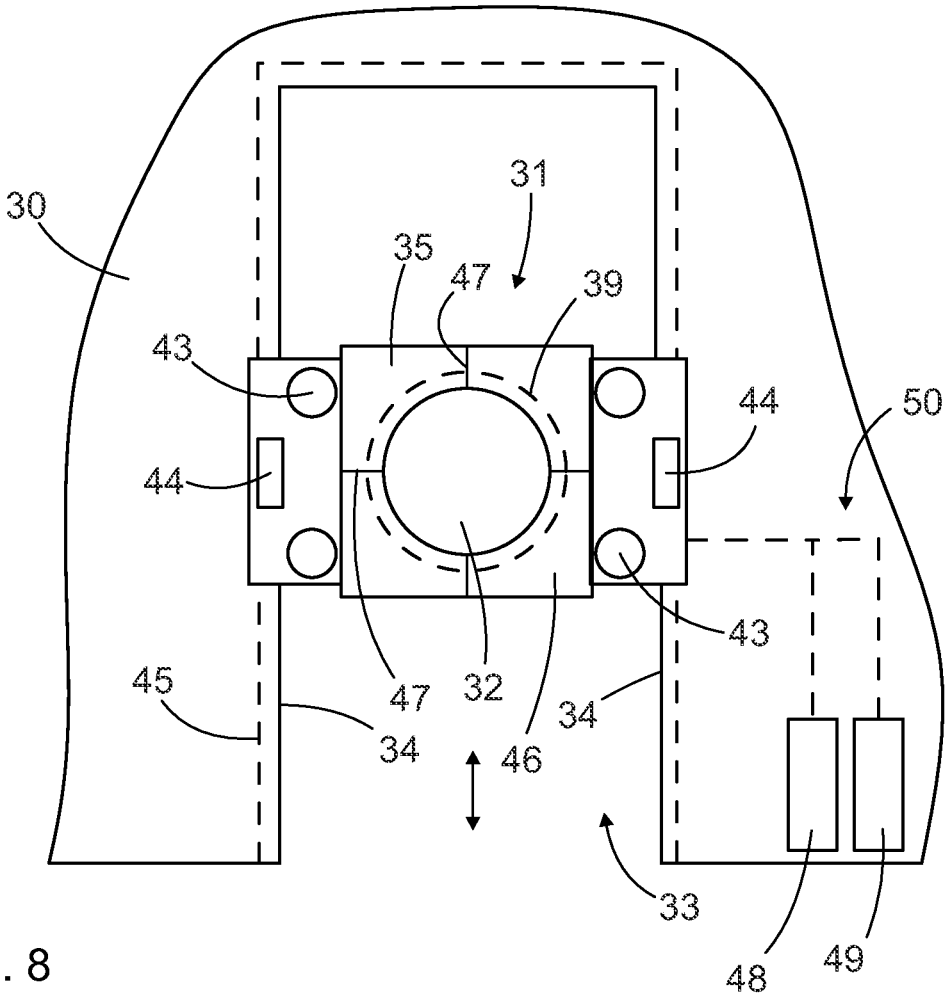
FIG. 8 is a schematic side view of a guide provided with bearing rollers.

FIG. 8 discloses an alternative solution for supporting a guide 31 to an opening 33 of a screen 30. The guide may comprises several roller elements 43 and 44 for supporting the guide 31 to edge portions 34 of the opening 33. Further, the opening 33 may be provided with a frame 45 or corresponding support structure for reinforcing the edge portions or providing bearing surfaces.

FIG. 8 further discloses that the guide 31 may be composed of several pieces between which are joints 47. In this case there are four piece which may be connected to each other by means of quick couplings, for example. Further, the guide 31 may comprise a uniform slide bearing ring 39, or alternatively the ring 39 may also formed of several connectable components. The ring 39 may be made of slide bearing material and it may comprise rounded edges ensuring smooth contact with the compensation element.

Between the screen 30, or bottom surface, there may be a spring element 48 and a damper 49 which both have effect on vertical movements of the guide 31. Transmission elements 50 have shown in a simplified manner. However, the transmission elements may comprise wire ropes, bars or any other suitable elements.

The drawings and the related description are only intended to illustrate the idea of the invention. In its details, the invention may vary within the scope of the claims.

The invention claimed is:

1. A compensation guide for a compensating element of a traction elevator, the compensating element being connected between a counterweight assembly and a car assembly of the elevator, comprising a body for mounting the compensation guide to a supporting structure, the body having a right side surface and a left side surface; and a guide opening in the body extending through the right side surface and the left side surface of the body through which the compensating element is mountable, the guide opening being configured to encircle the compensating element;

wherein the body has a vertically directed operational position wherein the guide opening is directed horizontally so that a horizontal portion of the compensation element is configured to pass through the guide opening, and wherein the body of the compensation guide comprises bearing elements on opposite vertical sides thereof, whereby the guide is vertically movable relative to the supporting structure.

2. The compensation guide as claimed in claim 1, wherein the guide is freely movable in a vertical direction along a vertical movement range due to the bearing elements, whereby the bearing elements provide the guide with a floating mounting relative to the supporting structure.

3. The compensation guide as claimed in claim 2, wherein the body comprises at least two separate components connectable to each other.

4. The compensation guide as claimed in claim 2, wherein the bearing elements comprise slide surfaces on the opposite vertical sides of the body.

5. The compensation guide as claimed in claim 2, wherein the bearing elements comprise bearing rollers on the opposite vertical sides of the body.

6. The compensation guide as claimed in claim 2, wherein the opening extends through the body is a first direction, and wherein the opposite vertical sides of the body are spaced from each other is a second direction, the second direction being different than the first direction.

7. The compensation guide as claimed in claim 1, wherein the body comprises at least two separate components connectable to each other.

8. The compensation guide as claimed in claim 7, wherein the bearing elements comprise slide surfaces on the opposite vertical sides of the body.

9. The compensation guide as claimed in claim 1, wherein the bearing elements comprise slide surfaces on the opposite vertical sides of the body.

10. The compensation guide as claimed in claim 1, wherein the bearing elements comprise bearing rollers on the opposite vertical sides of the body.

11. The compensation guide as claimed in claim 1, wherein the body comprises a slide bearing ring comprising slide bearing material.

12. A counterweight screen mountable to a pit of an elevator shaft and configured to serve as a partition wall for preventing objects to enter into a vertical movement space of a counterweight of a traction elevator, wherein the screen comprises a panel having a rectangular shape with two vertical side edges, a horizontal top edge and a horizontal bottom edge, wherein the panel is provided with at least one longitudinal opening extending a distance from the bottom edge towards the top edge, wherein the screen is provided with at least a compensating guide mounted vertically movably to the mentioned opening and wherein the compensation guide is in accordance with claim 1.

13. The counterweight screen as claimed in claim 12, wherein longitudinal edges of the opening of the screen are configured to provide support for the guide.

14. The counterweight screen as claimed in claim 12, wherein the compensation guide is connected to at least one spring element configured to effect vertical movements of the guide relative to the screen.

15. A traction elevator comprising:

a car assembly provided with an elevator car;

a counterweight assembly provided with a counterweight frame and at least one filler element;

a first guide assembly provided with first vertical guide rails mountable to an elevator shaft and first guide shoes mountable to the car assembly, and correspondingly a second guide assembly provided with second vertical guide rails and second guide shoes for the counterweight frame, wherein the first and second guide shoes are supportable against the guide rails;

a hoisting machinery comprising an electric motor and a traction sheave driven by the electric motor;

at least one suspension rope connecting the car assembly and the counterweight assembly and arranged to pass over the traction sheave;

at least one compensation element arranged between bottom parts of the counterweight assembly and the car assembly and comprising vertically hanging two vertical parts in the elevator shaft and a loop part connecting the vertical parts;

at least one compensation guide for providing support for the compensation element and comprising at least one guide opening through which the compensation element is arranged to pass; and a counterweight screen arranged at a pit of the elevator shaft and configured to serve as a guard structure preventing objects entering on movement path of the counterweight assembly, the compensation guide is arranged at the loop portion of the compensation element, whereby the compensation element is configured to be guided through a horizontally directed guide opening of the guide, and wherein the compensation guide is in accordance with claim 1.

16. The elevator as claimed in claim 15, wherein the elevator shaft comprises at least one counterweight buffer arranged at a bottom of the pit on movement path of the counterweight assembly; and wherein the horizontal compensation guide is located at a horizontal distance from the buffer.

17. A method for providing guidance for a compensation element of a traction elevator, the compensation element being arranged between bottom parts of a counterweight assembly and a car assembly of the elevator and comprising vertically hanging two vertical parts in an elevator shaft and a loop part connecting the vertical parts, wherein the method comprises:

directing the compensation element through a body having a right side surface and a left side surface, the body provided with a guide opening extending through the right side surface and the left side surface of the body; and directing the loop part of the compensation element through the guide opening; wherein the guide opening is directed horizontally and encircles the loop part.

18. The method as claimed in claim 17, further comprising supporting the compensation guide vertically movably to a counterweight screen of the elevator.

19. The method as claimed in claim 17, further comprising providing the compensation guide with a floating mounting and allowing the compensation guide to move vertically upwards from an initial normal position thereof.

20. The method as claimed in claim 17, further comprising allowing the compensation guide to move vertically upwards when the counterweight assembly is moved against a buffer whose vertical length is configured to shorten due to a buffer strike.

* * * * *